US011339346B2

(12) United States Patent
Maier et al.

(10) Patent No.: US 11,339,346 B2
(45) Date of Patent: May 24, 2022

(54) USE OF POLYESTERS AS VISCOSITY INDEX IMPROVERS FOR AIRCRAFT HYDRAULIC FLUIDS

(71) Applicant: Evonik Operations GmbH, Essen (DE)

(72) Inventors: Stefan Karl Maier, Shanghai (CN); Nicolai Kolb, Recklinghausen (DE); Michael Neusius, Darmstadt (DE)

(73) Assignee: Evonik Operations GmbH, Essen (DE)

( * ) Notice: Subject to any disclaimer, the term of this patent is extended or adjusted under 35 U.S.C. 154(b) by 100 days.

(21) Appl. No.: 16/462,356

(22) PCT Filed: Dec. 12, 2017

(86) PCT No.: PCT/EP2017/082341

§ 371 (c)(1),
(2) Date: May 20, 2019

(87) PCT Pub. No.: WO2018/108869

PCT Pub. Date: Jun. 21, 2018

(65) Prior Publication Data

US 2019/0382681 A1 Dec. 19, 2019

(30) Foreign Application Priority Data

Dec. 14, 2016 (EP) ..... 16203962

(51) Int. Cl.

| | |
|---|---|
| ***C10M 169/04*** | (2006.01) |
| ***C10M 105/74*** | (2006.01) |
| ***C10M 145/22*** | (2006.01) |
| *C10N 20/04* | (2006.01) |
| *C10N 30/02* | (2006.01) |
| *C10N 40/08* | (2006.01) |

(52) U.S. Cl.

CPC ..... *C10M 169/041* (2013.01); *C10M 105/74* (2013.01); *C10M 145/22* (2013.01); *C10M 2209/102* (2013.01); *C10M 2223/0405* (2013.01); *C10N 2020/04* (2013.01); *C10N 2030/02* (2013.01); *C10N 2040/08* (2013.01)

(58) Field of Classification Search

CPC ..... C10M 169/041; C10M 105/74; C10M 145/22; C10M 2209/102; C10M 2223/0405; C10M 2209/1023; C10M 111/04; C10N 2020/04; C10N 2030/02; C10N 2040/08; C10N 2020/017; C10N 2020/02; C10N 2030/08; C10N 2030/54; C10N 2030/64; C10N 2030/68

USPC ..... 508/440

See application file for complete search history.

(56) References Cited

U.S. PATENT DOCUMENTS

| | | | | |
|---|---|---|---|---|
| 3,707,500 | A | 12/1972 | Romano et al. | |
| 3,956,154 | A | 5/1976 | Marolewski et al. | |
| 4,298,489 | A | 11/1981 | Ohba et al. | |
| 5,665,686 | A * | 9/1997 | Schlosberg | C10M 101/02 508/485 |
| 5,922,658 | A * | 7/1999 | Duncan | C10L 10/08 508/492 |
| 6,391,225 | B1 * | 5/2002 | Poirier | C10M 169/04 252/78.5 |
| 2017/0174956 | A1 | 6/2017 | Ramon-Gimenez et al. | |
| 2017/0218295 | A1 | 8/2017 | Lauterwasser et al. | |
| 2019/0112511 | A1 | 4/2019 | Kolb et al. | |

FOREIGN PATENT DOCUMENTS

| | | |
|---|---|---|
| CH | 505 195 | 3/1971 |
| RU | 2108371 C1 | 4/1998 |
| RU | 2362800 C1 | 7/2009 |
| WO | 96/17517 A1 | 6/1996 |

OTHER PUBLICATIONS

"Phosphate Esters," CRC Handbook of Lubrication and Tribio, Jan. 1, 1993, CRC Press, GB, pp. 269-286 (18 pages).
International Search Report dated Apr. 18, 2018 in PCT/EP2017/082341 (4 pages).
Kolb et al., U.S. Appl. No. 16/099,212, filed Nov. 6, 2018.
Written Opinion dated Apr. 18, 2018 in PCT/EP2017/082341 (6 pages).

* cited by examiner

*Primary Examiner* — Prem C Singh
*Assistant Examiner* — Francis C Campanell
(74) *Attorney, Agent, or Firm* — Taylor English Duma LLP; Philip P. McCann

(57) ABSTRACT

The invention is related to a composition for use in hydraulic systems of an aircraft. The composition typically comprises an adipic acid-based polyester in a phosphate ester base stock substantially consisting of trialkyl phosphates.

15 Claims, No Drawings

USE OF POLYESTERS AS VISCOSITY INDEX IMPROVERS FOR AIRCRAFT HYDRAULIC FLUIDS

CROSS REFERENCE TO RELATED APPLICATIONS

This application is a 35 U.S.C. § 371 U.S. national phase entry of International Application PCT/EP2017/082341 having an international filing date of Dec. 12, 2017, which claims the benefit of European Application No. 16203962.2 filed Dec. 14, 2016, each of which is incorporated herein by reference in its entirety.

FIELD

The present invention is in the field of phosphate based hydraulic fluid compositions for use in hydraulic systems of an aircraft.

BACKGROUND

Hydraulic fluids for an aircraft, in particular for an aircraft operated at high altitudes, need to comply with a number of stringent requirements. The fluid must be substantially non-flammable to fulfil the requirements on fire resistance. Since an aircraft is typically operated at a wide range of environmental temperatures, the hydraulic fluid also needs to have suitable rheological properties within the entire temperature range to allow a reliable operation of the hydraulic systems. For instance, during take-off of an aircraft a hydraulic fluid may have a temperature above 60° C., whereas at an altitude above 10,000 m it may reach a temperature below −55° C.

It is particularly important that a hydraulic fluid has a sufficiently high viscosity at high temperatures and an acceptably low viscosity at low temperatures. Furthermore, the pour point and the cloud point of the hydraulic fluid must be sufficiently low so that the risk of a hydraulic system failure due to crystal formation or gel formation in the hydraulic fluid is minimised.

Additionally, the hydraulic fluid must possess the following properties:

- a sufficient lubricity, shear stability and chemical stability under typical operating conditions to be suitable for a long-term use,
- low corrosiveness towards typical aircrafts materials such as aluminium alloys, bronze, steel and the like,
- compatibility with gaskets, packing and other components of the hydraulic system,
- high hydrolytic stability, and
- low toxicity.

Commercially available hydraulic fluids for aircrafts are usually based on trialkyl phosphates such as tributyl phosphate or triisobutyl phosphate. These compounds have a low viscosity at increased temperatures and relatively high wear characteristics. To overcome this drawback of trialkyl phosphates their viscosities need to be adjusted using a viscosity index improver.

Unfortunately, many common viscosity index improvers have a poor compatibility with lower trialkyl phosphates at low temperatures and are therefore unsuitable for use in hydraulic systems of an aircraft.

Earlier patents such as U.S. Pat. No. 3,707,500 or CH 505 195 suggest modifying trialkyl phosphates by combining them with triaryl phosphates. Additionally, polymethacrylate-type viscosity index improvers may be employed. However, many triaryl phosphates are highly toxic and environmentally hazardous. Therefore, handling such hydraulic fluids by operating personnel during maintenance works on the aircraft poses considerable health hazards. An unexpected leakage of such hydraulic fluid may also become dangerous to the aircraft's crew, passengers and the environment.

Accordingly, numerous attempts have been undertaken to develop a substantially non-toxic hydraulic fluid for an aircraft based on trialkyl phosphates.

U.S. Pat. No. 3,956,154 describes a composition for an aircraft hydraulic system comprising a base stock consisting of trialkyl phosphate and low molecular weight propylene glycol polyesters of azelaic acid. Since low trialkyl phosphates such as tributyl phosphate showed a low compatibility with the proposed polymeric viscosity improvers at low temperatures, the authors of U.S. Pat. No. 3,956,154 additionally suggest adding triaryl phosphates such as mixed tricresyl and trixylenyl phosphates to the hydraulic fluid. Again, since these compounds have a high neurotoxicity and are environmentally hazardous, the resulting hydraulic fluid poses health hazards to the operating personnel, aircraft crew, passengers and the environment.

U.S. Pat. No. 6,391,225 B1 teaches an aircraft hydraulic fluid containing phosphate ester-based stocks in combination with some specific alkoxylated polyether amines. Unfortunately, such amines have a limited oxidation stability. This puts limitations on long-term use of the resulting hydraulic fluid composition.

U.S. Pat. No. 4,298,489 issued to Kao Soap describes use of aliphatic polyesters which may be derived from adipic acid as additives for triarylphosphate based fire resistant hydraulic fluids. This document is silent in respect to trialkylphosphate-based hydraulic fluids for an aircraft.

Thus, there is a continuous need for hydraulic fluids for use in an aircraft having an improved fluid life, improved fire resistance and a low-toxicity profile.

SUMMARY

The present invention is based on a surprising finding that polyesters comprising from 30 mol % to 50 mol % of adipic acid residues, based on the total number of repeating units constituting the polyester, and from 25 mol % to 50 mol %, based on the total number of repeating units constituting the polyester, of repeating units of Formula II

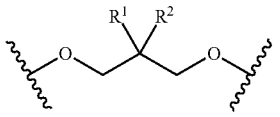

Formula II wherein $R^1$ is represented by a $C_{1-6}$-alkyl group, $R^2$ is a hydrogen atom or a $C_{1-6}$-alkyl group, and $R^1$ and $R^2$ together may form a cycloalkane structure have an excellent compatibility with trialkyl phosphate based base stocks at low temperatures.

Accordingly, a composition comprising said polyesters and trialkyl phosphates such as tributyl phosphate or triisobutyl phosphate and a hydraulic fluid comprising said composition have a surprisingly low pour point and cloud point.

Additionally, and even more importantly, the inventors found that the corresponding hydraulic fluid for an aircraft no longer requires the presence of additives such as triaryl phosphates, diarylalkyl phosphates or aryldialkyl phosphates. Accordingly, health hazards originating from these additives can be eliminated.

DETAILED DESCRIPTION

The hydraulic fluid of the present invention has a sufficiently high viscosity at ambient temperature and increased temperatures and a viscosity index of at least 200, preferably at least 260, particularly preferably at least 280. At the same time, its relatively low viscosity at low temperatures allows a reliable operating of the aircraft's hydraulic system.

Hence, the composition of the present invention and the hydraulic fluid of the present invention preferably contain less than 25 wt.-%, more preferably less than 15 wt.-%, even more preferably less than 5 wt.-%, yet even more preferably less than 1 wt.-%, particularly preferably less than 0.1 wt.-% of compounds selected from triaryl phosphates, diarylalkyl phosphates or aryldialkyl phosphates, based on the total weight of the composition. Thus, in a preferred embodiment, the composition of the present invention substantially consists of the polyester and the phosphate ester base stock.

One aspect of the present invention is a composition comprising a polyester and a phosphate ester base stock, wherein the polyester comprises from 30 mol % to 50 mol %, based on the total number of repeating units constituting the polyester, of repeating units of Formula I Formula I

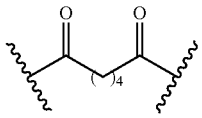

and from 25 mol % to 50 mol %, based on the total number of repeating units constituting the polyester, of repeating units of Formula II Formula II

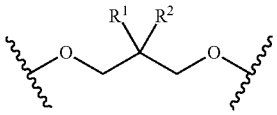

wherein $R^1$ is represented by a $C_{1-6}$-alkyl group, $R^2$ is a hydrogen atom or a $C_{1-6}$-alkyl group, and $R^1$ and $R^2$ together may form a cycloalkane structure; and the phosphate ester base stock substantially consists of one or several compounds, each of which being represented by Formula III;

Formula III

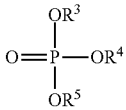

wherein $R^3$, $R^4$ and $R^5$ are each independently selected from a $C_{1-6}$-alkyl group.

Advantageously, the substituents $R^3$, $R^4$ and $R^5$ in the Formula III are identical $C_{3-6}$-alkyl groups, e.g. groups selected from n-butyl, isobutyl, sec-butyl and tert-butyl. In particular, the phosphate ester base stock may substantially consist of tributyl phosphate, triisobutyl phosphate or a mixture thereof. These compounds have a relatively low toxicity and have proved to be highly satisfactory in high-performance aircraft applications.

For the sake of achieving an optimal thickening efficiency at a wide temperature range and a particularly advantageous low-temperature performance, the weight average molecular weight Mw of the polyester typically ranges from 5,000 g/mol to 60,000 g/mol, preferably from 10,000 g/mol to 40,000 g/mol, more preferably from 10,000 to 30,000 g/mol, particularly preferably from 20,000 g/mol to 30,000 g/mol.

Furthermore, to ensure a good shear stability of the polyester in the phosphate ester base stock, the weight average molecular weight Mw of the polyester should be not higher than 100,000 g/mol, more preferably not higher than 80,000 g/mol, even more preferably not higher than 60,000 g/mol, and particularly preferably not higher than 50,000 g/mol.

The number average molecular weight Mn of the polyester is advantageously chosen in the range from 2,000 g/mol to 20,000 g/mol, preferably from 5,000 g/mol to 10,000 g/mol, particularly preferably from 6,000 g/mol to 9,000 g/mol.

The optimal performance of the polyester in the composition of the present invention can be achieved if the polydispersity index (PDI, PDI=Mw/Mn) is in the range from about 1.0 to about 10.0, preferably from about 2.0 to about 5.0, more preferably from about 2.5 to about 4.5.

The molecular weights Mw, Mn and PDI of the polyester can be determined using gel permeation chromatography (GPC) according to the norm DIN 55672-1 using tetrahydrofuran (THF) as an eluent and a polystyrene standard for calibration.

Mn (UV)=number average molecular weight (GPC, UV detection), expressed in g/mol

Mw (UV)=weight average molecular weight (GPC, UV detection), expressed in g/mol.

According to the present invention, at least 30 mol % of all repeating units of the polyester, i.e. at least 60 mol % of all acid-derived repeating units are adipic acid residues. However, the low-temperature performance of the composition of the present invention can be even further improved if the polyester comprises at least 35 mol % adipic acid residues, more preferably at least 40 mol %, and even more preferably at least 45 mol %, based on the total number of repeating units constituting the polyester. In a particularly preferred embodiment, about 50 mol % of all repeating units of the polyester i.e. substantially all acid-derived repeating units are adipic acid residues.

The content of adipic acid residues in the polyester can be determined using a common analytical technique such as $^1$H-NMR.

The polyester may further comprise acid-derived repeating units other than adipic acid residues, wherein the content of such repeating units should not exceed 20 mol %, based on the total number of repeating units constituting the polyester. Preferably, these acid-derived repeating units are residues of aliphatic dicarboxylic acids or anhydrides of aliphatic dicarboxylic acids. Suitable repeating units can be selected from the group consisting of succinic acid, succinic anhydride, glutaric acid, pimelic acid, suberic acid, azelaic acid, sebacic acid, undecanedioic acid and dodecanedioic acid. Azelaic acid, sebacic acid and dodecanedioic acid proved to be particularly suitable for this purpose.

Additionally, for the sake of achieving an optimal low-temperature performance of the composition, the content of aromatic dicarboxylic acids in the polyester is advantageously kept below 20 mol %, more preferably below 10 mol %, even more preferably below 5 mol %, yet even more preferably below 2 mol % and particularly preferably below 0.5 mol %, based on the total number of repeating units constituting the polyester. Again, the content of aromatic dicarboxylic acid residues in the polyester can be determined using a common analytical technique such as $^1$H-NMR.

The alcohol-derived repeating units of the polyester are derived from 2-substituted propylene glycols represented by Formula II. The substituents $R^1$ and $R^2$ may be selected from $C_{1-6}$-alkyl groups such as methyl, ethyl, n-propyl, isopropyl, n-butyl, sec-butyl, isobutyl, tert-butyl, n-pentyl, n-hexyl or cyclohexyl. The substituent $R^2$ may also be represented by a hydrogen atom. Preferred alcohol-derived repeating units are those wherein $R^1$ is a methyl group and $R^2$ is a hydrogen atom or a methyl group.

Furthermore, $R^1$ and $R^2$ together may form a cycloalkane structure e.g. an optionally substituted cyclopentane, cyclohexane, cycloheptane or cyclooctane group. Thus, the alcohol-derived repeating units may be derived from glycols such as 2-methyl-1,3-propanediol, 2,2-dimethyl-1,3-propanediol (neopentyl glycol), 2,2-diethyl-1,3-propanediol, 2-butyl-2-ethyl-1,3-propanediol, 2-butyl-2-methyl-1,3-propanediol, 2-ethyl-2-methyl-1,3-propanediol, 2-methyl-2-propyl-1,3-propanediol, 2-methyl-2-isopropyl-1,3-propanediol or 1,1-cyclohexanedimethanol. The low-temperature compatibility of the polyesters with the phosphate ester base stock appears to be particularly good if substituents $R^1$ and $R^2$ are independently selected from $C_{1-3}$-alkyl groups.

The inventors surprisingly found that hydraulic fluids having particularly advantageous low-temperature properties can be obtained with compositions of polyesters in which $R^1$ in Formula II is a methyl group and $R^2$ is a hydrogen atom. Furthermore, if $R^1$ and $R^2$ in the Formula II are both represented by methyl groups (i.e. the alcohol-derived repeating units are derived from neopentylglycol), the resulting hydraulic fluids show an excellent low-temperature behavior in combination with advantageous rheological properties over the entire relevant temperature range.

Accordingly, in one preferred embodiment, at least 25 mol % of all repeating units of the polyester, i.e. at least 50 mol % of all alcohol-derived repeating units are derived from neopentylglycol or from 2-methyl-1,3-propandiol. However, the low-temperature performance of the composition of the present invention can be even further improved if at least 30 mol % of all repeating units of the polyester, more preferably at least 40 mol %, and even more preferably at least 45 mol % of all repeating units of the polyester are derived from neopentylglycol or from 2-methyl-1,3-propandiol, based on the total number of repeating units constituting the polyester. In a particularly preferred embodiment, about 50 mol % of all repeating units of the polyester i.e. substantially all alcohol-derived repeating units are derived from neopentylglycol or from 2-methyl-1,3-propandiol.

In some embodiments, the polyester may further comprise alcohol-derived repeating units derived from alcohols having three or more hydroxy-functionalities. If such alcohol-derived repeating units are present, the content should be below 1.0 mol %, more preferably below 0.5 mol %, even more preferably below 0.1 mol %, based on the total number of repeating units constituting the polyester. Examples of suitable alcohols include glycerol, 1,1,1-tri(hydroxymethyl) propane, xylitol etc.

In a particularly preferred embodiment of the present invention, the polyester comprises about 50 mol %, based on the total number of repeating units constituting the polyester, of adipic acid residues and about 50 mol %, based on the total number of repeating units constituting the polyester, of repeating units of Formula II, wherein $R^1$ and $R^2$ in the Formula II are both represented by methyl groups i.e. the repeating units are derived from neopentylglycol.

The low-temperature properties of the composition of the present invention and, in particular, of the corresponding hydraulic fluid are particularly advantageous when the employed polyesters are substantially amorphous. For the purposes of the present invention, amorphous polyesters are polyesters which exhibit only a 2nd order phase transition at a glass transition temperature Tg, measured by differential scanning calorimetry (DSC), without simultaneously exhibiting any crystalline or semicrystalline behavior, i.e. with no discernible other melting points in DSC. A particular feature of amorphous polyesters is that melt viscosity falls only slowly as temperature rises above the glass transition temperature. In contrast, melt viscosity rises steeply with rising molecular weight, and high process temperatures around 260° C. or higher are therefore usually necessary in order to produce the products. A DSC measurement of the glass transition temperature Tg can be carried out using dynamic DSC according to the norm DIN 53765. The values stated are taken from a second heating cycle.

Without wishing to be bound by a theory, the inventors believe that it is beneficial in terms of low-temperature behavior of the composition if the glass transition temperature Tg of the polyester, if present, is lower than −15° C., preferably lower than −25° C., even more preferably lower than −35° C., and particularly preferably lower than −45° C. This relationship has not been known before and appears to serve as a potential indicator on how a polymer may behave at low temperatures in a phosphate ester base stock.

The melting point temperature Tm of the polyester, if present, is preferably below 40° C., more preferably below 20° C., even more preferably below 10° C. The melting point temperature can be measured using a DSC according to the norm ASTM D3417. However, polyesters having no Tm are particularly preferable.

Compatibility of the polyesters with the phosphate ester-based stock at low-temperatures is particularly high when the employed polyesters are characterized by an OH value (hydroxyl value) in the range from 2.0 to 40 mg KOH/g, preferably from 5.0 to 20 mg KOH/g, even more preferably from 5.0 to 15 mg KOH/g. The hydroxyl value is determined in accordance with the norm DIN 53240-2. In this method, the sample is reacted with acetic anhydride in the presence of 4-dimethylamino-pyridine as catalyst, whereupon the hydroxyl-groups are acetylated. One molecule of acetic acid is produced for each hydroxy group here, while the subsequent hydrolysis of the excess acetic anhydride provides two molecules of acetic acid. The consumption of acetic acid is determined titrimetrically from the difference between the principle value and a blind value to be determined in parallel.

Typically, the acid value of the polyester is in particular in the range from 0.01 to 3.0 mg KOH/g, preferably from 0.1 to 2.0 mg KOH/g, even more preferably from 0.1 to 1.0 mg KOH/g. These ranges are advantageous in terms of long-time performance of the composition and compatibility with the phosphate ester-based stock. In particular, these acid values ensure that the hydrolysis of the phosphate ester-based stock is minimised. The acid value can be determined in accordance with the norm DIN EN ISO 2114. The acid value is the amount in mg of potassium hydroxide required to neutralize the acids present in one gram of the polyester. The specimen to be investigated is dissolved in dichloromethane and titrated with 0.1 N methanolic potassium hydroxide solution in the presence of phenolphthalein.

The method for the preparation of the polyesters is not particularly limited and any method known in the prior art can be employed. For example, conventional polymerization methods such as molten acidolysis and slurry polymerization methods for preparing polymer are suitable, whereas the molten acidolysis method is particularly preferred. In this method, the monomeric adipic acid is heated to give a molten solution, and then this solution is reacted to give the molten polymer in the presence of a polycondensation catalyst. The final step of this method may be carried out under vacuum to facilitate removal of volatile by-products such as water or cleavage diols.

Suitable polycondensation catalysts are known to the person skilled in the art and include zinc compounds, germanium dioxide, antimony triacetate, and titanium compounds, and in particular zinc acetate, germanium dioxide, or titanium compounds. In particular, butyl titanate, propyl titanate, octylene glycol titanate or Tyzer TEP can be advantageously used. The amount of the catalytically active species used is generally from 2.5 ppm to 100 ppm, in particular from 10 ppm to 75 ppm, based on the polyester, where the ppm data are based on weight of the reaction mixture (ppm by weight).

According to the present invention, the polyester has an excellent solubility in the phosphate ester base stock. Therefore, in the composition of the invention, the polyester is usually substantially completely dissolved in the phosphate ester basestock.

In one preferred embodiment, the composition of the present invention substantially consists of the polyester and the phosphate ester base stock.

For instance, the composition of the present invention may have comprise from 0.5 to 75 wt.-%, based on the weight of the composition, of the polyester and from 25 to 99.5 wt.-%, based on the weight of the composition, of the phosphate ester base stock, and the phosphate ester base stock substantially consists of tributylphosphate, triisobutylphosphate or a mixture thereof.

For instance, the composition of the present invention may substantially consist of from 0.5 to 75 wt.-%, based on the weight of the composition, of the polyester and from 25 to 99.5 wt.-%, based on the weight of the composition, of the phosphate ester base stock, and the phosphate ester base stock substantially consists of tributylphosphate, triisobutylphosphate or a mixture thereof.

For instance, the composition of the present invention may have comprise from 45 to 75 wt.-%, based on the weight of the composition, of the polyester and from 25 to 55 wt.-%, based on the weight of the composition, of the phosphate ester base stock, and the phosphate ester base stock substantially consists of tributylphosphate, triisobutylphosphate or a mixture thereof.

In particular, the composition of the present invention may substantially consist of from 45 to 75 wt.-%, based on the weight of the composition, of the polyester and from 25 to 55 wt.-%, based on the weight of the composition, of the phosphate ester base stock, and the phosphate ester base stock substantially consists of tributylphosphate, triisobutylphosphate or a mixture thereof.

The above composition can be conveniently stored and handled. In particular, it can be conveniently used for the preparation of a hydraulic liquid for an aircraft by mixing it with a phosphate ester base stock.

In a further aspect, the present invention relates to a hydraulic liquid for an aircraft comprising the composition as described above, wherein the hydraulic liquid comprises from 0.5 wt % to 20 wt %, based on the weight of the hydraulic liquid, of the polyester and not less than 50 wt. %, based on the weight of the hydraulic liquid, of the phosphate ester base stock.

The hydraulic liquid of the present invention offers a number of advantages. In particular, it has

- favorable combustibility/flammability characteristics,
- improved cost/performance ratio,
- improved low temperature performance,
- low toxicity,
- a low shear degradation, and
- good resistance to oxidation and high long-term chemical stability.

The viscosity of the hydraulic fluid of the present invention is adjustable over a broad range to comply with various requirements. Furthermore, due to its high shear stability the hydraulic fluid is suitable for high pressure applications.

Finally, the hydraulic liquid of the present invention is biodegradable and environmentally acceptable and can be produced on a cost favorable basis.

Preferably, the hydraulic fluid of the present invention is substantially anhydrous. According to a special aspect of the present invention, the hydraulic fluid contain 5 wt.-% or less, preferably 2 wt.-% or less, even more preferably 1 wt.-% or less water, based on the total weight of the hydraulic fluid.

The hydraulic fluid according to the present invention may comprise one or more polyesters as described above, preferably in a solid polymer amount of from 0.1 wt.-% to 25 wt.-%, more preferably from 0.5 wt.-% to 20 wt.-%, and even more preferably from 5.0 wt.-% to 15.0 wt.-%, by the total weight of hydraulic fluid.

The hydraulic fluid typically comprises from 60 wt.-% to about 95 wt.-%, based on the total weight of the hydraulic fluid, of trialkyl phosphates. The alkyl groups of the trialkyl phosphates include aliphatic and alicyclic groups wherein the aliphatic groups include straight and branched alkyl groups. Examples of trialkyl phosphate esters include, by way of example, tri-n-butyl phosphate, tri(isobutyl) phosphate, tri(sec-butyl) phosphate, di(isobutyl) pentyl phosphate, tri(n-pentyl) phosphate, tri-2-ethylhexyl phosphate, and the like. Preferred trialkyl phosphates include tributyl phosphate and triisobutyl phosphate. Mixtures of trialkyl phosphates can be used. Preferred mixtures of trialkyl phosphates include mixtures of tri(isobutyl) phosphate and tri(n-butyl) phosphate in a vol.-ratio of about 1:1 to about 10:1, more preferably in a ratio of about 2:1 to about 3:1.

The hydraulic fluid of the present invention may comprise further additives known in the art such as further viscosity index improvers, acid scavengers, antioxidants, anti-wear agents, corrosion inhibitors, detergents, dispersants, EP additives, anti-foam agents, friction reducing agents, pour point depressants, dyes, odorants and/or demulsifiers. These additives are used in conventional amounts. Usually the hydraulic fluids contain 0 to 10 wt.-% of these additives. The corresponding additives are well-known to a skilled person and are described inter alia in WO 96/17517 A1, the entire disclosure of which is incorporated herein by reference.

Notwithstanding the above, in one embodiment the hydraulic liquid of the present invention substantially consists of the polyester, the phosphate ester base stock and at least one further additive selected from corrosion inhibitors, antifoam agents, acid scavengers and dyes.

Typically, the hydraulic fluid of the present invention has a kinematic viscosity at 100° C. (as measured by ASTM D 7042) in the range of from 1 to 30 $mm^2/s$ (cSt), preferably from 1 to 25 cSt, and more preferably from 2 to 12 cSt, e.g. from 2 to 5 cSt. Preferably, the hydraulic fluid has a kinematic viscosity at 100° C. (as measured by ASTM D 7042) of at least 2.5 cSt, more preferably at least 3.0 cSt. In one embodiment of the present invention, the hydraulic fluid has a kinematic viscosity at 100° C. of at most 11.0 cSt, preferably at most 9.0 cSt more preferably at most 8.0 cSt.

The hydraulic fluid may have a kinematic viscosity at 40° C. (as measured by ASTM D 7042) in the range of from 1 to 40 cSt, preferably from 5 to 30 cSt, and more preferably from 10 to 25 cSt. Preferably, the hydraulic fluid has a kinematic viscosity at 40° C. (as measured by ASTM D 7042) of at least 5.0 cSt, more preferably at least 7.0 cSt. In one embodiment of the present invention, the hydraulic fluid has a kinematic viscosity at 40° C. of at most 50.0 cSt, preferably at most 40.0 cSt, more preferably at most 30.0 cSt.

Preferably, the hydraulic fluid has a viscosity index (VI) (determined to ASTM D 2270) in the range of from 100 to 500, more preferably in the range of from 200 to 400 and most preferably in the range of from 250 to 350.

To ensure a reliable operating of hydraulic systems of an aircraft at high altitudes, the hydraulic fluid preferably has a pour point (measured according to ASTM D 5950) of below −30° C., more preferably below −40° C., even more preferably below −50° C., yet even more preferably below −60° C., still even more preferably below −70° C. and particularly preferably below −80° C.

Furthermore, the kinematic viscosity of the hydraulic fluid at −54° C. (KV−54) is advantageously not higher than 2,000 cSt, preferably not higher than 1,500 cSt, more preferably not higher than 1,400 cSt, even more preferably not higher than 1,300 cSt, particularly preferably not higher than 1,200 cSt.

The cloud point of the hydraulic fluid (as measured according to ASTM D 2500) is preferably below −30° C., more preferably below −40° C., even more preferably below −50° C., yet even more preferably below −60° C., still even more preferably below −70° C. and particularly preferably below −80° C. This ensures that no precipitates are formed in hydraulic systems of an aircraft at high altitudes.

As already mentioned above, the hydraulic fluid of the present invention also has an excellent shear stability. Its relative shear loss after 40 min Ultrasonic shear test, measured according to ASTM D5621 at 40° C. is typically not higher than 10%, preferably not higher than 5%, even more preferably not higher than 3%.

The following examples will illustrate the present invention in detail but are not limiting in any way.

EXAMPLES

Abbreviations

SUC succinic acid
ADI adipic acid
AV acid value
AZE azelaic acid
BD-1,4 1,4-butanediol
BF-26 Brookfield viscosity at −26° C.
CP cloud point
DDA dodecanoic diacid
DSC differential scanning calorimetry
HD-1,6 1,6-hexanediol
Hyjet™ V fire resistant aviation fluid commercially available from ExxonMobil
KV40 kinematic viscosity at 40° C.
KV100 kinematic viscosity at 100° C.
KV−54 kinematic viscosity at −54° C.
NPG neopentylglycol
MPD-1,3 2-methyl-1,3-propanediol
MEG monoethyleneglycol
Mn number average molecular weight
Mw weight average molecular weight
OHV hydroxyl value
PD-1,3 1,3-propanediol
PD-1,2 1,2-propanediol
PDI polydispersity index
PP pour point
SEC size exclusion chromatography
SEB sebacic acid
SL 40° C. relative shear loss after 40 min Ultrasonic shear test
TBP tributylphosphate
TiBP triisobutylphosphate
Tg glass transition temperature
Tm melting point
TMP trimethylolpropane
TPA terephthalatic acid
VI viscosity index Analytical Methods Pour points were determined using an ISL MPP 5Gs mini cloud and pour point analyser according to ASTM D7346.

Cloud points were determined using an ISL MPP 5Gs mini cloud and pour point analyser according to ASTM D7689.

Molecular weights of the polyesters were determined according to DIN 55672-1 by SEC in tetrahydrofuran using polystyrene standards for calibration.

Melting and glass transition temperatures of the polyesters Tm and Tg were determined by DSC according to DIN 53765.

Kinematic viscosities were measured according to ASTM D445. Calculation of viscosity index is described in ASTM D2270.

Brookfield viscosities were measured according to DIN 51398.

Shear loss in the ultrasonic shear test was determined according to ASTM D5621.

The hydroxyl values were determined by titration according to DIN 53240-2. Values are reported as mg (KOH)/g (sample).

The acid values were determined by titration according to DIN EN ISO 2114. Values are reported as mg (KOH)/g (sample).

Densities were determined according to ASTM D 4052.

General Procedure for the Preparation of Polyesters

One or more diacids were melted together with an excessive amount of one or more diols in a molar ratio of mol(diacids):mol(diols)=1.0:1.01-1.0:1.5 under nitrogen atmosphere in a flask with distillation head. At a temperature of 240° C., most of the water formed during the reaction was removed by distillation within about 4 to 6 hours.

Subsequently, 0.01 wt.-% of a homogeneous titanium catalyst was added, and the pressure in the apparatus was lowered stepwise to 10 mbar. The reaction has considered to be complete when no carboxylic acid groups are present (AV<1 mg KOH/g polyester) and the desired OHV was reached.

Examples 1-10 and Comparative Examples 1-15

Polyesters of Examples 1-10 and Comparative Examples 1-15 where prepared according to the general procedure. The compositions of the polyesters are shown in Table 1 below. The contents of the repeating units in the Table 1 are expressed in mol %, based on the total number of repeating units constituting the polyester.

Polyesters of Examples 1-10 fall under the definition of present Claim 1.

Polyesters of Comparative Examples 1-3, 5, 8, 13-15 and 17 comprised less than 25 mol % of alcohol-derived repeating units of the Formula II, based on the total number of repeating units constituting the polyester:

Formula II

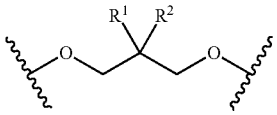

Polyesters of Comparative Examples 3-4, 6, 7, 9-12 and 17 comprised less than 30 mol % of repeating units derived from adipic acid, based on the total number of repeating units constituting the polyester.

Comparative Examples 1-17 where analysed as described above. The resulting values are summarized in Table 2.

As can be noted from Table 2, the polyesters were mostly terminated by OH functionalities, as a result of appropriate reaction conditions during the polyester preparation. This is considered advantageous since acid functionalities of polyesters may contribute to hydrolysis of phosphate ester hydraulic fluids.

The branched polyester Comparative Example 16 had an exceptionally high Mw. This is a direct result of the trifunctional repeating unit derived from trimethylolpropane. Unfortunately, the branching process during the polyester formation could not be controlled and resulted in a broad variety of differently structured polymers which is reflected in a very broad molecular weight distribution.

Generally speaking, if during the polyester formation polyfunctional repeating units are used in high concentrations, insoluble gel networks may be formed. However, if there are used in relatively low concentrations below 1.0 mol %, formation of soluble branched polyesters will take place.

TABLE 1

| | Diacids (mol %) | | | | | | Alcohols (mol %) | | | | | | | |
|---|---|---|---|---|---|---|---|---|---|---|---|---|---|---|
| | SUC | ADI | AZE | SEB | DDA | TPA | NPG | MPD-1,3 | PD-1,3 | PD-1,2 | BD-1,4 | HD-1,6 | MEG | TMP |
| Ex. 1 | | 50% | | | | | 33.5% | | | | | 16.5% | | |
| Ex. 2 | | 50% | | | | | 50% | | | | | | | |
| Ex. 3 | | 50% | | | | | 33.5% | | | | | | 16.5% | |
| Ex. 4 | | 50% | | | | | 50% | | | | | | | |
| Ex. 5 | | 50% | | | | | 50% | | | | | | | |
| Ex. 6 | | 50% | | | | | 50% | | | | | | | |
| Ex. 7 | | 50% | | | | | 50% | | | | | | | |
| Ex. 8 | | 30% | | 20% | | | 35% | | | | | | 15% | |
| Ex. 9 | 20% | 30% | | | | | 25% | 25% | | | | | | |
| Ex. 10 | | 40% | 10% | | | | 35% | | | | | 7.5% | 7.5% | |
| Comp. Ex. 1 | | 50% | | | | | 20% | | | | 15% | 15% | | |
| Comp. Ex. 2 | 20% | 30% | | | | | 10% | | | | | 40% | | |
| Comp. Ex. 3 | | 25% | | 25% | | | | 20% | | | | 30% | | |
| Comp. Ex. 4 | | 25% | | | 25% | | | 50% | | | | | | |
| Comp. Ex. 5 | | 50% | | | | | 15% | | | | 20% | | 15% | |
| Comp. Ex. 6 | | | | 50% | | | 33.5% | | | | | 16.5% | | |
| Comp. Ex. 7 | | | | 50% | | | | 33.5% | | | | 16.5% | | |
| Comp. Ex. 8 | | 50% | | | | | 16.5% | | | | | 33.5% | | |
| Comp. Ex. 9 | 50% | | | | | | 50% | | | | | | | |
| Comp. Ex. 10 | 50% | | | | | | 33.5% | | | | | | 16.5% | |
| Comp. Ex. 11 | 50% | | | | | | 16.5% | 33.5% | | | | | | |
| Comp. Ex. 12 | 50% | | | | | | | 33.5% | | | | | 16.5% | |
| Comp. Ex. 13 | | 50% | | | | | | 16.5% | | | | 33.5% | | |
| Comp. Ex. 14 | | 40% | 10% | | | | | 20% | 15% | | 15% | | | |
| Comp. Ex. 15 | | 30% | | 20% | | | 20% | | 30% | | | | | |
| Comp. Ex. 16 | | 50% | | | | | 49% | | | | | | | 1% |
| Comp. Ex. 17 | | 10% | | | | 40% | 21.5% | | | 10.5% | | | 18% | |

Comparative Examples 16 and 17

To investigate the effects of aromatic acid-derived repeating units, a polyester of Comparative Examples 17 was prepared. Its composition is shown in Table 1. For the preparation of the polyester of Comparative Example 17 a mixture of adipic acid and terephthalic acid was employed.

The polyester of Comparative Example 16 was prepared using a small amount of the trifunctional alcohol component TMP which results in a non-linear structure of the prepared polymer.

Characterization of the Polyesters

Weight average molecular weights Mw, number average molecular weights Mn, polydispersity index PDI as well as AV and OHV of the polyesters of Examples 1-10 and

TABLE 2

| | AV [mg KOH/g] | OHV [mg KOH/g] | Mn [kg/mol] | Mw [kg/mol] | PDI |
|---|---|---|---|---|---|
| Ex. 1 | 0.3 | 14.0 | 8.2 | 24.3 | 3.0 |
| Ex. 2 | 0.3 | 12.0 | 7.6 | 26.3 | 3.5 |
| Ex. 3 | 0.2 | 21.0 | 7.0 | 23.7 | 3.4 |
| Ex. 4 | 0.2 | 9.4 | 8.7 | 37.2 | 4.3 |
| Ex. 5 | 0.7 | 7.0 | 5.2 | 13.9 | 2.7 |
| Ex. 6 | 0.3 | 11.0 | 7.8 | 26.1 | 3.3 |
| Ex. 7 | 0.5 | 12.0 | 7.3 | 22.9 | 3.1 |
| Ex. 8 | 0.6 | 9.2 | 8.8 | 32.1 | 3.6 |
| Ex. 9 | 0.3 | 8.8 | 8.6 | 31.6 | 3.7 |
| Ex. 10 | 0.3 | 10.0 | 8.4 | 32.1 | 3.8 |
| Comp. Ex. 1 | 0.3 | 8.9 | 8.0 | 34.2 | 4.3 |

TABLE 2-continued

| | AV [mg KOH/g] | OHV [mg KOH/g] | Mn [kg/mol] | Mw [kg/mol] | PDI |
|---|---|---|---|---|---|
| Comp. Ex. 2 | 0.6 | 9.0 | 7.2 | 32.8 | 4.6 |
| Comp. Ex. 3 | 0.5 | 9.8 | 8.6 | 33.0 | 3.8 |
| Comp. Ex. 4 | 0.6 | 10.8 | 9.4 | 32.6 | 3.5 |
| Comp. Ex. 5 | 0.6 | 10.0 | 8.7 | 35.4 | 4.1 |
| Comp. Ex. 6 | 0.2 | 13.0 | 8.6 | 30.0 | 3.5 |
| Comp. Ex. 7 | 0.3 | 18.0 | 7.4 | 23.1 | 3.1 |
| Comp. Ex. 8 | 0.2 | 18.0 | 6.1 | 20.6 | 3.4 |
| Comp. Ex. 9 | 0.9 | 11.0 | 7.8 | 27.3 | 3.5 |
| Comp. Ex. 10 | 1.0 | 13.0 | 6.9 | 25.9 | 3.8 |
| Comp. Ex. 11 | 1.1 | 11.0 | 7.5 | 23.6 | 3.1 |
| Comp. Ex. 12 | 0.7 | 11.0 | 7.3 | 23.9 | 3.3 |
| Comp. Ex. 13 | 0.2 | 16.0 | 6.0 | 21.1 | 3.5 |
| Comp. Ex. 14 | 0.3 | 14.0 | 6.5 | 24.2 | 3.7 |
| Comp. Ex. 15 | 0.9 | 16.0 | 5.9 | 22.2 | 3.8 |
| Comp. Ex. 16 | 0.3 | 12.3 | 8.8 | 105.0 | 11.9 |
| Comp. Ex. 17 | 6.0 | 3.4 | 11.4 | 30.5 | 2.7 |

Glass transition temperatures Tg and melting points Tm of the polyesters of Examples 1-10 and Comparative Examples 1-17 were measured as described above.

The resulting values are summarized in Table 3:

TABLE 3

| | Tg [° C.] | Tm [° C.] |
|---|---|---|
| Ex. 1 | −55.0 | — |
| Ex. 2 | −47.0 | — |
| Ex. 3 | −47.0 | — |
| Ex. 6 | −43.5 | — |
| Ex. 7 | −44.1 | — |
| Ex. 8 | −51.9 | — |
| Ex. 9 | −39.5 | — |
| Ex. 10 | −52.4 | — |
| Comp. Ex. 1 | −57.8 | — |
| Comp. Ex. 2 | −57.0 | 23.0 |
| Comp. Ex. 3 | −62.0 | 24.0 |
| Comp. Ex. 4 | −55.0 | 11.0 |
| Comp. Ex. 5 | −52.6 | — |
| Comp. Ex. 6 | −61.0 | 23.0 |
| Comp. Ex. 7 | −56.0 | 18.0 |
| Comp. Ex. 8 | −57.2 | 64.0 |
| Comp. Ex. 9 | −18.0 | — |
| Comp. Ex. 10 | −17.0 | — |
| Comp. Ex. 11 | −20.0 | — |

TABLE 3-continued

| | Tg [° C.] | Tm [° C.] |
|---|---|---|
| Comp. Ex. 12 | −22.0 | — |
| Comp. Ex. 13 | −59.0 | 35.0 |
| Comp. Ex. 14 | −59.8 | — |
| Comp. Ex. 15 | −59.2 | — |
| Comp. Ex. 16 | −44.3 | — |
| Comp. Ex. 17 | 29.0 | — |

A comparison of the data in Table 3 with those in Table 4 shows that no direct correlation exists between Tg and Tm of polyesters and the low-temperature behavior of the corresponding polyesters in phosphate ester base stocks (cf. Table 4 below).

Nevertheless, it is worth noting that all polyesters of Examples 1-10 are amorphous polymers without a melting point and having a glass transition temperatures below −30° C.

Properties of Polyesters in a Solution of a Phosphate Ester Base Stock 13 wt.-% solutions of polyesters of Examples 1-10 and Comparative Example 1-8, 10, 11 and 13-17 in tributyl phosphate were prepared at room temperature. All the corresponding polyesters had a sufficient initial solubility in tributyl phosphate. An attempt to dissolve the polyester of Comparative Examples 9 and 12 in tributyl phosphate revealed that the corresponding polyesters are not sufficiently soluble.

The polyesters of Comparative Examples 11 and 17 precipitated as a gel after some time. Although the branched polyester of Comparative Example 17 had good viscosimetric properties, the broad molecular weight distribution rendered it vulnerable to mechanical shear forces. This resulted in a significantly higher shear loss than in the case of other polyesters which renders the polymer unsuitable for the targeted application.

The remaining investigated polyesters formed clear stable solutions in tributyl phosphate which did not show any precipitates or haze upon storage. All soluble polyesters increased the viscosity of tributyl phosphate and provided a significant increase of viscosity index.

The properties of the tributyl phosphate solutions were determined as described above. The corresponding experimental data are summarized in Table 4:

TABLE 4

| | 13 wt-% solution in TBP | | | | | |
|---|---|---|---|---|---|---|
| | KV40 [cSt] | KV100 [cSt] | VI | SL 40° C. | PP [° C.] | CP [° C.] |
| Ex. 1 | 18.3 | 5.82 | 305 | 2.2% | −90 | <−105 |
| Ex. 2 | 17.5 | 5.68 | 313 | 2.6% | −90 | <−105 |
| Ex. 3 | 15.7 | 5.16 | 309 | 2.4% | −90 | <−105 |
| Ex. 4 | 21.3 | 6.81 | 320 | not measured | −90 | <−105 |
| Ex. 5 | 9.8 | 3.35 | 260 | 0.7% | −93 | <−105 |
| Ex. 6 | 18.6 | 6.00 | 314 | not measured | −90 | <−105 |
| Ex. 7 | 16.1 | 5.24 | 307 | not measured | −90 | <−105 |
| Ex. 8 | 25.6 | 8.11 | 323 | not measured | −87 | <−105 |
| Ex. 9 | 22.3 | 6.96 | 308 | not measured | −84 | <−105 |
| Ex. 10 | 23.7 | 7.46 | 317 | not measured | −84 | <−105 |
| Comp. Ex. 1 | 30.0 | 8.95 | 303 | 2.5% | −81 | −41 |
| Comp. Ex. 2 | 31.0 | 9.15 | 300 | not measured | −96 | −12 |
| Comp. Ex. 3 | 35.0 | 10.17 | 297 | not measured | −102 | −5 |
| Comp. Ex. 4 | 31.3 | 9.25 | 301 | not measured | −81 | −43 |
| Comp. Ex. 5 | 27.7 | 8.47 | 310 | 3.0% | −96 | −36 |
| Comp. Ex. 6 | 25.4 | 7.86 | 311 | 2.0% | −39 | −24 |
| Comp. Ex. 7 | 21.4 | 6.63 | 301 | 1.2% | −36 | −17 |
| Comp. Ex. 8 | 17.0 | 5.39 | 295 | 1.1% | −60 | −9 |
| Comp. Ex. 9 | | | | insoluble | | |

TABLE 4-continued

| | 13 wt-% solution in TBP | | | | | |
|---|---|---|---|---|---|---|
| | KV40 [cSt] | KV100 [cSt] | VI | SL 40° C. | PP [° C.] | CP [° C.] |
| Comp. Ex. 10 | 15.3 | 4.89 | 288 | 2.6% | −72 | −44 |
| Comp. Ex. 11 | precipitated after 1 day storage at room temperature | | | | | |
| Comp. Ex. 12 | insoluble | | | | | |
| Comp. Ex. 13 | 18.3 | 5.68 | 292 | 1.0% | <−105 | 2 |
| Comp. Ex. 14 | 22.1 | 6.75 | 279 | not measured | −90 | −50 |
| Comp. Ex. 15 | 19.3 | 6.08 | 302 | not measured | −87 | −79 |
| Comp. Ex. 16 | 44.8 | 14.09 | 329 | 32.4% | −84 | <−105 |
| Comp. Ex. 17 | could be dissolved but became a gel at room temperature | | | | | |

All tested soluble polyesters showed an advantageous behavior in tributyl phosphate at increased temperatures, and, in particular, appropriate KV40, KV100 and VI.

In addition, the polyesters according to the present invention, which were prepared in Examples 1-10 had an excellent compatibility with tributyl phosphate at low temperatures. This behavior is particularly important for hydraulic fluids for an aircraft, because these are exposed to temperatures of −50° C. or even lower during the flight. Thus, to ensure a safe and reliable operating of hydraulic systems of the aircraft, it is highly desirable that the hydraulic fluids have a pour point at least below −60° C., preferably below −75° C. All tested polyesters of the present invention complied with this requirement.

In contrast, solutions of Comparative Examples showed significantly higher pour points.

A further requirement on hydraulic fluids for an aircraft is compatibility between the phosphate ester-based stock and the thickener, in particular at low temperatures. A reliable indicator of this compatibility is cloud point, since it indicates phase separation already at an early stage. Importantly, all polyesters according to the present invention, i.e. those of Examples 1-10 had cloud points below −105° C.

Solutions of Comparative Examples, Comparative Example 16 being the only exception, had cloud points of not lower than −78° C. In other words, the corresponding polyesters have a significantly lower compatibility with the phosphate ester base fluid.

Although the solution of the Comparative Example 16 had a cloud point below −105° C. i.e. the polyester had an excellent compatibility with the phosphate ester base fluid, the pour point of the solution was only −84° C.

In summary, the results in Table 4 show that polyesters which are compatible over the whole relevant temperature range with the phosphate ester-based stock should contain adipic acid and branched alcohols such as NPG or MPD as main repeating units. Other repeating units may also be included in the polyester in smaller amounts. However, they become detrimental to compatibility with the phosphate ester based stock, if present in larger quantities.

Formulation Examples

A 9.0 wt.-% solution of the polyester of Example 1 in tributyl phosphate and 8.3 wt.-% solution of the polyester of Example 4 in tributyl phosphate were prepared at room temperature. The rheological properties of the resulting solutions were compared to a commercially available product Hyjet™ V (a fire-resistant aviation fluid obtainable from ExxonMobil). Hyjet™ V is a typical phosphate ester based lubricant which is used in aviation.

The obtained results are summarized in Table 5:

TABLE 5

| | Example 1 | Example 4 | Hyjet ™ V |
|---|---|---|---|
| | 9.0% in TBP | 8.3% in TBP | |
| KV40 [cSt] | 10.4 | 10.6 | 10.6 (37.8° C.) |
| KV100 [cSt] | 3.59 | 3.73 | 3.6 (98.9° C.) |
| VI | 276 | 294 | 280 |
| PP [° C.] | −96 | −96 | <−62 |
| SL 40° C. | 2.1% | 3.8 | 21% |
| BF-26 [mPas] | 304 | not measured | not measured |
| KV-54 [cSt] | 1 206 | 1 118 | 1 350 |
| Density at 15.6° C. [g/mL] | not measured | 0.991 | 1.000 |

The solutions of polyesters of Examples 1 and 4 in tributyl phosphate and the commercial product Hyjet™ V have a similar rheological behavior at 40° C. and 100° C. However, the low-temperature properties of the materials of the present invention (KV−54) are significantly better than those of the commercial product Hyjet™ V.

Furthermore, the shear stabilities of the polyesters of Examples 1 and 4 are remarkably higher than that of Hyjet™ V. Higher shear stabilities result in a more reliable performance over time and indicate a reduced temporary shear loss.

Furthermore and even more importantly, polymer shear stabilities correlate with energy efficiency of a hydraulic fluid. Thus, the polyesters of the present invention allow an even more reliable and efficient operating of hydraulic systems of an aircraft than the commercial product Hyjet™ V.

Dilution of Polyesters with a Phosphate Base Stock

For ease of handling, viscosity improvers are often sold in a diluted form. The diluents used are typically base stocks in which the commercial product is later applied. Table 6 shows viscosity of compositions consisting of polyesters of Examples 1 and 4 diluted with some tributylphosphate.

TABLE 6

| Polyester | Weight % in TBP | KV100 [cSt] |
|---|---|---|
| Example 1 | 80 | 1 790 |
| Example 1 | 70 | 853 |
| Example 1 | 60 | 400 |
| Example 1 | 50 | 187 |
| Example 4 | 55 | 369 |

The viscosities of the compositions allow their convenient handling.

The invention claimed is:

1. An aircraft hydraulic fluid composition comprising from 5.0 wt% to 20 wt%, based on the weight of the aircraft hydraulic fluid composition, of a polyester and not less than 50 wt.%, based on the weight of the aircraft hydraulic fluid composition, of a phosphate ester base stock, wherein the polyester has a weight average molecular weight Mw from 10,000 g/mol to 40,000 g/mol and consists of 50 mol%, based on the total number of repeating units constituting the polyester, of repeating units of Formula I Formula I

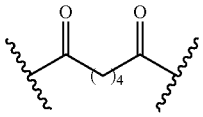

and 50 mol%, based on the total number of repeating units constituting the polyester, of repeating units of Formula II Formula II

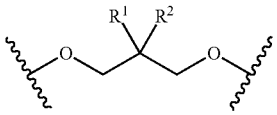

wherein $R^1$ is a methyl group, $R^2$ is a methyl group; and wherein the phosphate ester base stock substantially consists of tributylphosphate, triisobutylphosphate or a mixture thereof, and wherein the hydraulic fluid composition contains less than 5 wt % of compounds selected from the group consisting of triaryl phosphates, diarylalkyl phosphates, and aryldialkyl phosphates, based on the total weight of the aircraft hydraulic fluid composition, wherein the aircraft hydraulic fluid composition has a pour point of below −30° C.

2. The aircraft hydraulic fluid composition according to claim 1, wherein the aircraft hydraulic fluid has a pour point of below −40° C.

3. The aircraft hydraulic fluid composition according to claim 1, wherein the weight average molecular weight Mw of the polyester is from 10,000 g/mol to 30,000 g/mol determined according to DIN 55672-1.

4. The aircraft hydraulic fluid composition according to claim 1, wherein the aircraft hydraulic fluid composition has a pour point of below −50° C.

5. The aircraft hydraulic fluid composition according to claim 1, wherein the polyester has an acid value from 0.01 to 3.0 mg KOH/g and a hydroxyl value from 5.0 to 20.0 mg KOH/g.

6. The aircraft hydraulic fluid composition according to claim 1, wherein the polyester has a polydispersity index Mw/Mn from 2.0 to 5.0.

7. The aircraft hydraulic fluid composition according to claim 1, wherein the polyester comprises end groups and more than 80 mol% based on the total number of end groups in the polyester, are hydroxyl groups.

8. The aircraft hydraulic fluid composition according to claim 1, wherein the polyester is an amorphous polymer and has a glass transition temperature Tg below −35 ° C.

9. The aircraft hydraulic fluid composition according to claim 1, wherein the aircraft hydraulic fluid composition substantially consists of the polyester and the phosphate ester base stock.

10. The aircraft hydraulic fluid composition according to claim 1, wherein the aircraft hydraulic liquid composition substantially consists of the polyester, the phosphate ester base stock and at least one further additive selected from corrosion inhibitors, antifoam agents, acid scavengers and dyes.

11. The aircraft hydraulic fluid composition according to claim 1, wherein the aircraft hydraulic fluid composition has a kinematic viscosity at 100° C. (KV100) of from 2.0 to 5.0 cSt and a kinematic viscosity at −54° C. (KV-54) of not higher than 2,000 cSt.

12. The aircraft hydraulic fluid composition of the composition according to claim 1, wherein the aircraft hydraulic fluid composition has a viscosity index (VI) from 200 to 400.

13. The aircraft hydraulic fluid composition according to claim 1, wherein the polyester has a polydispersity index Mw/Mn from 2.5 to 4.5.

14. The aircraft hydraulic fluid composition according to claim 1, wherein the polyester comprises end groups and more than 90 mol% based on the total number of end groups in the polyester, are hydroxyl groups.

15. The aircraft hydraulic fluid composition according to claim 1, wherein the weight average molecular weight Mw of the polyester is from 20,000 g/mol to 30,000 g/mol determined according to DIN 55672-1.

* * * * *